US010039947B2

(12) United States Patent
Conrad et al.

(10) Patent No.: US 10,039,947 B2
(45) Date of Patent: Aug. 7, 2018

(54) TRAMPOLINE

(71) Applicant: Eurotramp Trampoline—Kurt Hack GmbH, Weilheim/Teck (DE)

(72) Inventors: Bastian Conrad, Weilheim/Teck (DE); Johannes Maier, Göppingen (DE); Katja Ferger, Giessen (DE); Matthias Ottenberg, Osnabrück (DE); Konrad Tiefenbacher, Saarbrücken (DE)

(73) Assignee: Eurotramp Trampoline—Kurt Hack GmbH, Weilheim/Teck (DE)

( * ) Notice: Subject to any disclaimer, the term of this patent is extended or adjusted under 35 U.S.C. 154(b) by 0 days.

(21) Appl. No.: 15/323,747

(22) PCT Filed: Jun. 12, 2015

(86) PCT No.: PCT/EP2015/063167
§ 371 (c)(1),
(2) Date: Jan. 4, 2017

(87) PCT Pub. No.: WO2016/000928
PCT Pub. Date: Jan. 7, 2016

(65) Prior Publication Data

US 2017/0157444 A1 Jun. 8, 2017

(30) Foreign Application Priority Data

Jul. 4, 2014 (EP) ..... 14175727

(51) Int. Cl.
*A63B 5/11* (2006.01)
*A63B 21/02* (2006.01)
*A63B 24/00* (2006.01)
*A63B 71/06* (2006.01)

(52) U.S. Cl.
CPC ..... *A63B 5/11* (2013.01); *A63B 21/023* (2013.01); *A63B 24/0062* (2013.01); *A63B 71/0622* (2013.01); *A63B 2220/40* (2013.01); *A63B 2220/51* (2013.01); *A63B 2220/56* (2013.01); *A63B 2220/62* (2013.01); *A63B 2220/80* (2013.01); *A63B 2220/833* (2013.01)

(58) Field of Classification Search
CPC ..... A63B 5/11
See application file for complete search history.

(56) References Cited

U.S. PATENT DOCUMENTS

2002/0137598 A1 9/2002 Publicover
2011/0034300 A1* 2/2011 Hall ..... A63B 5/11 482/1

FOREIGN PATENT DOCUMENTS

EP 2505235 A1 10/2012
WO 2014/098628 A1 6/2014

* cited by examiner

*Primary Examiner* — Loan H Thanh
*Assistant Examiner* — Rae Fischer
(74) *Attorney, Agent, or Firm* — Michael Soderman

(57) ABSTRACT

The trampoline (1) as per the invention is comprised of a frame structure (2) and a jumping mat mounted in the frame structure (2). An arrangement of sensors (8) is provided by means of which forces or accelerations acting on the jumping mat (3) are recorded. The signals of the sensors (8) are read into an evaluation unit (9). Output quantities are generated from the chronological progression of the signals.

6 Claims, 1 Drawing Sheet

TRAMPOLINE

CROSS REFERENCE TO RELATED APPLICATIONS

This application is the U.S. national stage of International Application No. PCT/EP2015/063167, filed on 2015 Jun. 12. The international application claims the priority of EP 14175727.8 filed on 2014 Jul. 4; all applications are incorporated by reference herein in their entirety.

BACKGROUND

The invention relates to a trampoline and a method for monitoring the jumps performed on a trampoline.

Trampolines of this type are used in diverse applications both in the area of recreational activities and in the area of competition.

When used in the area of competition, jumps that an athlete carries out on the trampoline are evaluated in a familiar way by judges. An important evaluation criterion in connection with this is the flight time of a jump of the athlete, i.e. a determination has to be made as precisely and objectively as possible as to the length of time an athlete remains in the air after becoming airborne during a jump on the trampoline. This determination of the flight time can only be estimated in an imprecise way by judges. The use of light barriers as measurement systems that are installed under the plane of the jumping mats is known to obtain more reliable values for the flight times. The light barriers then operate in such a way that their beam path is not interrupted when the trampoline is not used or the respective athlete has just become airborne from the jumping mat during a jump on the trampoline. On the other hand, the beam path is interrupted when the athlete lands on the jumping mat, causing a downward bulge, and the jumping mat gets in the beam path of the light beams.

A drawback in connection with this is that the light barriers can be interrupted once again via a subsequent oscillation of the jumping mat right when the athlete becomes airborne, which can distort the measurement results for the flight time.

A further drawback results because the measurement system with the light barriers is limited to the determination of flight times.

SUMMARY

The trampoline (1) as per the invention is comprised of a frame structure (2) and a jumping mat mounted in the frame structure (2). An arrangement of sensors (8) is provided by means of which forces or accelerations acting on the jumping mat (3) are recorded. The signals of the sensors (8) are read into an evaluation unit (9). Output quantities are generated from the chronological progression of the signals.

DETAILED DESCRIPTION

The invention is based on the problem of making a system available by means of which information with regard to the jumps performed on a trampoline that is as comprehensive and precise as possible can be obtained with little expense for a trampoline of the type mentioned at the outset.

The features of the independent claims are provided to solve this problem. Advantageous embodiments and useful design developments of the invention are described in the dependent claims.

The trampoline as per the invention comprises a frame structure and a jumping mat mounted on the frame structure. An arrangement of sensors is provided by means of which forces or accelerations acting on the jumping mat are recorded. The signals of the sensors are read into an evaluation unit. Output quantities are generated from the chronological progression of the signals.

The method as per the invention for monitoring jumps performed on at least one trampoline; the trampoline has a frame structure and a jumping mat mounted on it. Forces or accelerations acting on the jumping mat are recorded via an arrangement of sensors. The signals of the sensors are read into an evaluation unit; output quantities can be generated from the chronological progression of the signals.

The basic idea of the invention is to use sensors as a measurement system for a trampoline that provide forces and accelerations and therefore measured quantities that represent a direct reaction of the jumping mat to jumps that are performed on it. Jumps performed on the jumping mat can therefore be analyzed in a precise and direct way.

It is important in connection with this for the evaluation of the sensor signals to take place in a time-resolved fashion. Chronological progressions of jumps on the trampoline can, as a result, be completely and precisely analyzed. It is advantageous in connection with this that the sensor signals can be directly evaluated, meaning without delay, in the evaluation unit for generating the output quantities, so the output quantities can be made available for a user in real time, meaning without delays, during the jumps performed on the trampoline.

Forces acting on the jumping mat during the performance of jumps on the trampoline can be precisely recorded with the sensors. The characteristic behavior of the jumping mat when jumps are performed is taken into account in the evaluation of the sensor signals. If a gymnast is in a downward movement during a jump, there will be an increase in force on the jumping mat. Conversely, the forces decrease when a gymnast is in an upward movement in the jumping mat. As soon as the gymnast has become airborne from the jumping mat, the jumping mat subsequently oscillates at its natural frequency, which leads to oscillating forces that are recorded with the sensors. Finally, the force load is constant when the jumping mat is in its rest position. Taking these relationships into consideration, the beginning and the end of a jump on the jumping mat of the trampoline can be precisely recorded with the sensors of the measurement system as per the invention. The flight time and, derived from that, also the flight height of a jump can be derived from that in the evaluation unit as output quantities. An especially advantageous type of measured-value evaluation consists in putting the currently obtained sensor signals of the sensors into the context of reference values.

The output quantities can be determined in a simple manner and a high level of accuracy because of that. The reference values are advantageously determined via reference measurements before the measurement system is put into operation.

In accordance with an advantageous embodiment of the invention, the sensors distributed around the periphery of the trampoline so that position-dependent output quantities for jumps performed on the trampoline are obtained in the evaluation unit from the signals of the sensors.

The output quantities generated from these sensor signals can provide insight, in particular, as to whether a gymnast performs his jumps in the middle of the jumping mat or offset to the side of the center of the jumping mat. A substantially expanded functional scope of the measurement system as per the invention is obtained because of that.

In general, a combination of sensor signals is formed for this; differences of sensor signals are formed as a preference. Jumps on the trampoline that are offset to the side of the center of the jumping mat will namely lead to different sensor signals of the distributed sensors.

The sensors of the measurement system as per the invention can be designed, in principle, in the form of acceleration sensors by means of which accelerations of the jumping mat that are caused by jumps on the trampoline are recorded. The acceleration sensors are designed in such a way in the process that they not only record the magnitudes, but also the directions of accelerations. Acceleration sensors of that type can be arranged, for instance, on elastic elements that are used to fasten the jumping mat to the frame structure. In general, the acceleration sensors can also be arranged on the frame structure of the trampoline.

In accordance to a further advantageous embodiment, the sensors of the measurement system can be designed in the form of force sensors; they are advantageously arranged on the frame structure of the trampoline. The sensors that are designed in that way then measure the forces that act on the jumping mat during jumps on it and that are then transferred to the frame structure of the trampoline.

As an example, the sensors are designed as force sensors in the form of pressure sensors or strain gauges.

As a preference, optical sensors such as distance sensors, scanning sensors, light scanners, light curtains and the like can be provided as additional sensors to record deformations of the jumping mat during the performance of jumps.

The frame structure will preferably have a frame accommodating the jumping mat and base legs. The sensors are arranged on the base legs; one sensor is arranged on each base leg as a useful arrangement.

Because of the attachment of the sensors to the base legs, they are evenly arranged around the periphery of the jumping mat. Spatially resolved information is then obtained via the combination, especially via the formation of differences of the sensor signals, that provides insight as to the location of the jumping mat where the respective gymnast is landing during the performance of jumps.

Especially simple mounting of the sensors is possible when the sensors are arranged on the bottom of the base legs.

In accordance with an advantageous embodiment of the invention, the evaluation unit has an output unit.

The output unit can, as an example, be at a terminal of a PC, a laptop or a tablet computer; its computer unit constitutes the evaluation unit.

The measurement system as per the invention can be installed in a simple fashion, in particular as a retrofitting set for trampolines of any design. The measurement system is robust and has little susceptibility to manipulation here.

A first field of use of the measurement system as per the invention is the recording of measured values for trampolines used in the area of competition. In so doing, judges can, on the one hand, follow the output quantities generated for this with the measurement system on a terminal of a PC or the like during the jumps of an athlete. Moreover, the output quantities can also be displayed on a video screen or the like as a further output unit so that the output quantities can also be followed along by the public.

The output quantities generated by the measurement system represent a tool that leads to a substantial reduction in the burdens of the judges. Furthermore, objective quantities are generated with the output quantities that make an evaluation of the jumps of an athlete possible that is free of subjective aspects.

The flight time and, derived from that, the jump height are advantageously determined in the process as an output quantity during the performance of the jumps on the trampoline and output in real time to the display unit. These output quantities form important evaluation criteria in the competitions carried out on trampolines.

The position of the athlete on the jumping mat of the trampoline can be determined via a spatially resolved evaluation of the sensor signals as an additional evaluation criterion. As an example, whether, and the extent to which, the landing point of the athlete on the jumping mat varies during the individual jumps can be precisely ascertained via the position determination. In so doing, a drift of the landing points going beyond a limit value can be evaluated with a deduction of points. Finally, these measurements can also be evaluated as a safety criterion to the effect that an athlete will be sanctioned, especially disqualified, if he leaves a specific safety zone of the jumping mat.

The measurement system as per the invention can also be used for purposes of training management. A coach can evaluate the jumps of an athlete on the trampoline with the aid of the output quantities. In particular, an analysis can be done as to whether certain jumps that are to be newly learned will lead to strong drifting movements of the athlete on the jumping mat. Furthermore, the output quantities can also be used to document the performances of different athletes.

The measurement system as per the invention can be extended to the effect that sensors are arranged on several trampolines, preferably arranged next to one another; the sensor signals of all of the sensors can be evaluated in a common evaluation unit for generating output quantities. In the process, a determination can be made as to the extent to which athletes perform synchronous jumps on the individual trampolines. The term synchronous includes, on the one hand, monitoring of the chronological synchronicity of the jumps on the trampolines here. Moreover, spatial synchronicity is checked, meaning recording is done as to whether jumps are performed on the same sub-areas of the trampolines.

The measurement system as per the invention can also be used as a means for quality control of the respective trampoline. As an example, a determination can be made via a recording over a longer period of time of force progressions that are registered with the sensors as to whether signs of fatigue are arising in the components of the trampolines, especially the jumping mat and the elastic elements used to attach the jumping mat to the frame structure.

Finally, the measurement system can also be used for trampolines that are employed in the area of leisure and recreation.

BRIEF DESCRIPTION OF THE DRAWINGS

The invention will be explained with the aid of the drawings below. The following are shown in the figures.

DETAILED DESCRIPTION OF THE PREFERRED EMBODIMENTS

Figure 1:
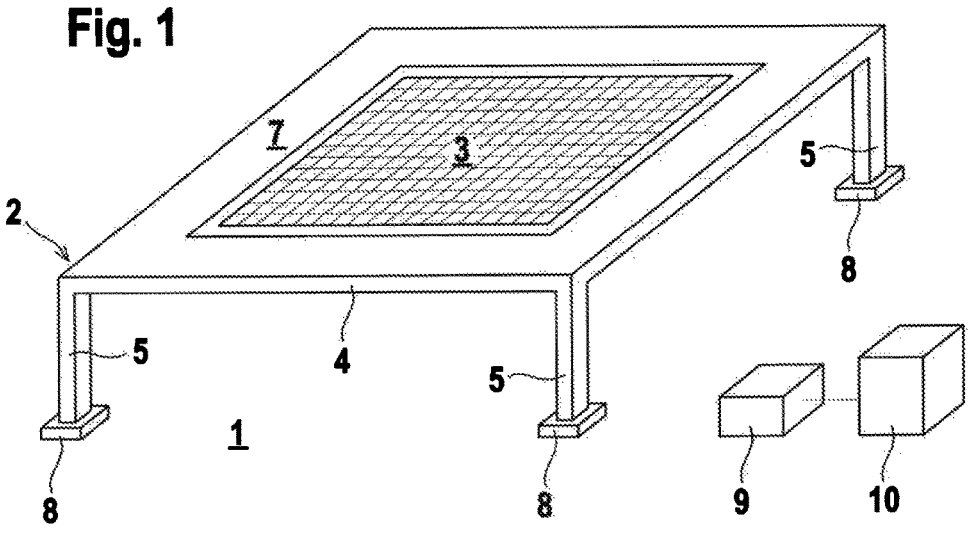
FIG. 1: Schematic diagram of the trampoline with a measurement system as per the invention.

FIG. 1 schematically shows an example of a trampoline 1 that has a frame structure 2 and a jumping mat 3 mounted in it as components.

The frame structure 2 is essentially comprised of a rectangular frame 4 and base legs in the form of support legs 5 that are connected to it to set this up on a base. The general, the frame structure 2 can be folded together here.

Figure 2:
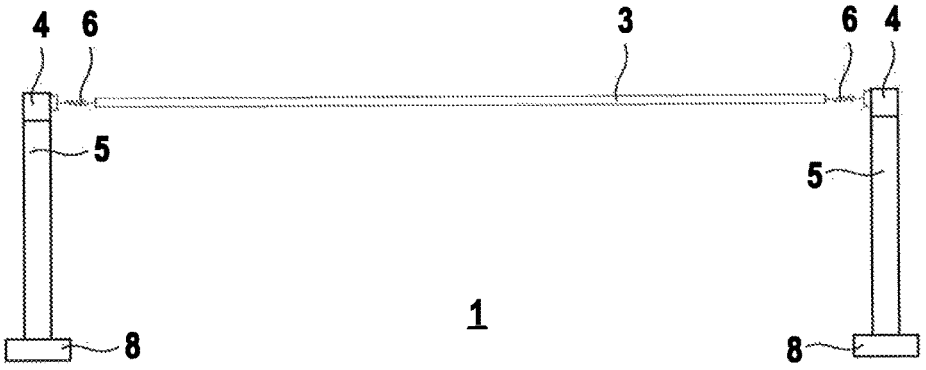
FIG. 2: Sectional view of the frame structure of the trampoline in accordance with FIG. 1 with the jumping mat held in place in it.

The jumping mat 3 is held in place in the frame 4 of the frame structure 2, as evident from FIG. 2. Springs 6, which are then fixed in place on the interior of the frame 4, are fastened as elastic elements along the entire circumference of the jumping mat 3 for this.

As evident from FIG. 1, the springs 6 are concealed by coverings 7 to prevent the risk of injury from contact of the person using the trampoline 1 with the springs 6.

A measurement system is also located on the trampoline 1. The measurement system is comprised of an arrangement of sensors 8, which are designed to be force-measuring plates in this case, into which strain gauges or the like are integrated as sensor elements. As evident in FIG. 1, a sensor 8 is mounted on the bottom of this support leg 5 in each case, so that frame structure 2 is completely supported on the sensors 8. The sensors 8 have an identical design and are connected via supply lines, which are not shown, to a central evaluation unit 9. An output unit 10 is connected to the evaluation unit 9. In the simplest case, the evaluation 9 is comprised of a computer unit of a PC, laptop or tablet computer; its terminal constitutes the output unit 10. In general, a data transmission system operating in a contact-free manner can be provided between the sensors 8 and the evaluation unit 9.

The forces that are exerted by a gymnast on the jumping mat 3 when making contact with it and that are transferred from the jumping mat 3 to the frame structure 2 are recorded with the sensors 8 in a time-resolved manner during the performance of jumps on the trampoline 1.

The sensor signals are read into the evaluation unit 9. Output quantities are generated from the sensor signals in real time, meaning without delay, in the evaluation unit 9 and likewise output without delay at the output unit 10.

The output quantities that are formed in this way constitute characteristic parameters for the jumps performed on the trampoline 1; these characteristic parameters are continuously generated in the evaluation unit 9 during the performance of the jumps and output at the output unit 10.

The flight times or flight heights during the individual jumps performed on the trampoline 1 can be determined as first output quantities. To this end, the point in time as to when a gymnast leaves the jumping mat 3, meaning becomes airborne at the beginning of a jump from the jumping mat 3, is determined, on the one hand, with the aid of the sensor signals of the sensors 8. On the other hand, the landing point of the gymnast on the jumping mat 3 is then determined with the aid of the sensor signals.

The known reaction behavior of the jumping mat 3 during the performance of the jumps is used here in the evaluation of the sensor signals produced by the sensors 8. A gymnast will be in a downwards movement in the jumping mat 3 after landing on the jumping mat 3 at the end of a jump. An increasing force will be exerted on the jumping mat 3 because of this that is transferred to the frame structure 2 and then registered by the sensors 8. Dropping force values will be analogously registered when the gymnast is in a downwards movement in the jumping mat 3. If the gymnast has become airborne from the jumping mat 3, the jumping mat 3 will subsequently oscillate at its natural frequency; oscillating force values will therefore arise that are registered by the sensors 8. Constant force values will be received at the sensors 8 when the jumping mat 3 of the trampoline 1 is at rest.

The flight time and, derived from that, the flight height of the jumps performed on the trampoline 1 can be determined in the evaluation unit 9 via the use of this characteristic behavior. The sensor signals of a sensor 8 suffice for this in principle. The above-mentioned characteristic parameters are advantageously determined from the sum of several or all of the sensors 8.

The position of the gymnast on the trampoline 1 can be determined as a further output quantity via the formation of differences of the sensor signals. The symmetrical arrangement of the sensors 8 with reference to the jumping mat 3 is used here. If a gymnast lands exactly in the center of the jumping mat 3 after a jump, the sensors 8 will deliver the same sensor signals, meaning force values, due to their symmetrical arrangement. If, in contrast, the gymnast lands on the jumping mat 3 at an offset to the center, the sensors 8 will deliver different sensor signals. The position of the gymnast on the jumping mat 3 can therefore be determined via the evaluation of the differences of the sensor signals.

The force measurements with the sensor signals are advantageously put into context with reference values that are determined via reference measurements before the measurement system is put into operation.

LIST OF REFERENCE NUMERALS (1) Trampoline
(2) Frame structure
(3) Jumping mat
(4) Frame
(5) Support leg
(6) Spring
(7) Covering
(8) Sensor
(9) Evaluation unit
(10) Output unit

The invention claimed is:

1. A trampoline comprising:

a frame structure having a frame and base legs distributed around the periphery of the frame;

a jumping mat mounted in the frame structure; and a plurality of sensors arranged on the bottom of the base legs of the frame structure, wherein the sensors are configured to sense forces acting on the jumping mat and to transmit signals containing information about the sensed forces to an evaluation unit, wherein the information about the sensed forces includes magnitude, time or position of the force acting on the jumping mat, and wherein the position of the sensors around the periphery of the trampoline permits position-dependent information for jumps performed on the trampoline to be transmitted to the evaluation unit.

2. The trampoline according to claim 1, wherein each sensor is a pressure sensor or a strain gauge.

3. The trampoline according to claim 1, wherein the evaluation unit has an output unit.

4. The trampoline according to claim 1, wherein force sensor signals are continuously generated during a use of the trampoline.

5. The trampoline according to claim 4, wherein the evaluation unit has a display unit for display of information determined from the signals transmitted by the force sensors.

6. The trampoline according to claim 1, wherein the jump position, the flight time, or the flight height of a person performing jumps on the jumping mat are determined in the evaluation unit in response to reception of signals from the force sensors.

* * * * *